US006510945B1

(12) United States Patent
Allwein et al.

(10) Patent No.: US 6,510,945 B1
(45) Date of Patent: Jan. 28, 2003

(54) TOOL FREE, EASY-OPENING INSULATION PACKAGE

(75) Inventors: Robert J. Allwein; Larry J. Weinstein, both of Littleton; John A Fry, Conifer; Vern C. Plotts, Littleton; Jo M. Teague, Littleton; William H. Olbert, Littleton, all of CO (US)

(73) Assignee: Johns Manville International, Inc., Denver, CO (US)

( * ) Notice: Subject to any disclaimer, the term of this patent is extended or adjusted under 35 U.S.C. 154(b) by 229 days.

(21) Appl. No.: 09/156,749

(22) Filed: Sep. 17, 1998

(51) Int. Cl.[7] ..... B65H 55/00
(52) U.S. Cl. ..... 206/388; 206/417; 206/442
(58) Field of Search ..... 206/388, 417, 206/442, 497, 83.5; 229/87.05

(56) References Cited

U.S. PATENT DOCUMENTS 1,630,542 A * 5/1927 Schulz ..... 229/87.05
2,057,121 A * 10/1936 Trevellyan ..... 206/388
2,308,197 A * 1/1943 Meyer ..... 206/497
2,681,702 A * 6/1954 Kuenn et al. ..... 206/417
4,805,383 A 2/1989 Allwein
5,380,094 A * 1/1995 Schmidt et al. ..... 206/83.5
5,934,809 A * 8/1999 Marbler ..... 229/87.05

FOREIGN PATENT DOCUMENTS

DE 804587 * 4/1951 ..... 229/87.05

* cited by examiner

*Primary Examiner*—Luan K. Bui
*Assistant Examiner*—Troy Arnold
(74) *Attorney, Agent, or Firm*—Robert D. Touslee

(57) ABSTRACT

An easy-opening insulation package for containing a stack of resilient insulation batts, such as but not limited to glass fiber insulation batts, is formed from a sheet material. The sheet material completely encircles the batts and has a stress riser that extends longitudinally with respect to the batts for the length of the batts. Preferably, the sheet material has at least one tear line, such as a perforated line, extending generally perpendicular to and crossing the stress riser for creating an opening in the package through the rupture of the sheet material by hand along the perforated line and for permitting the stress riser to be separated by hand from the opening created along the perforated line to gain access to the batts within the package. Preferably, the ends of the package are closed and the perforated line completely encircles the package to permit the package to be separated into two sections by rupturing the perforated line along its entire length.

20 Claims, 3 Drawing Sheets

FIG. 1
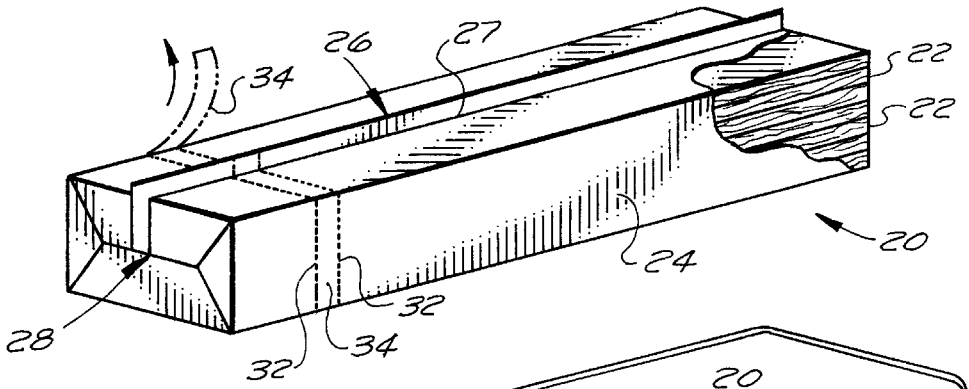
FIG. 2
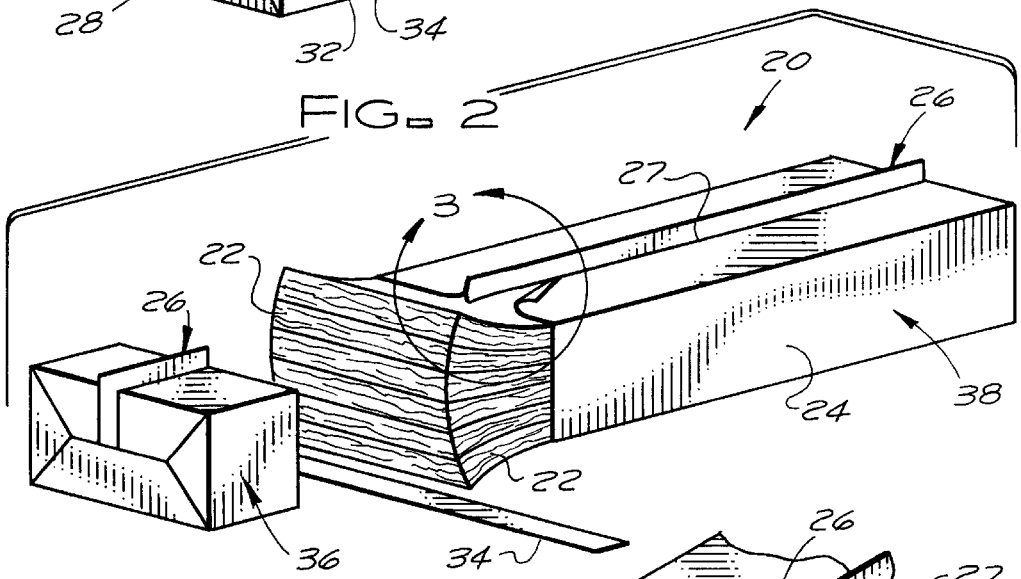
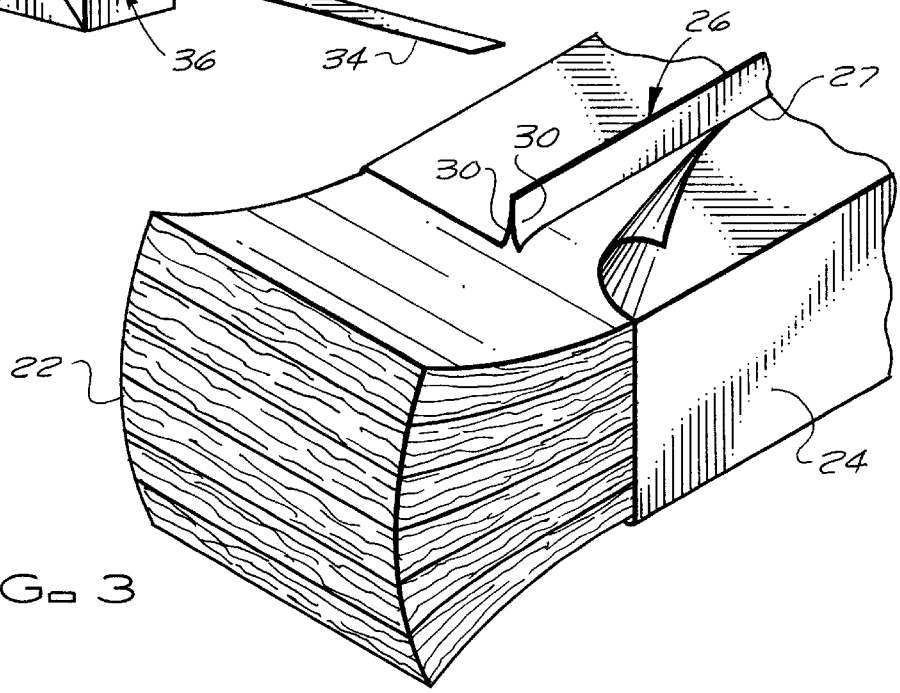
FIG. 3

FIG. 8
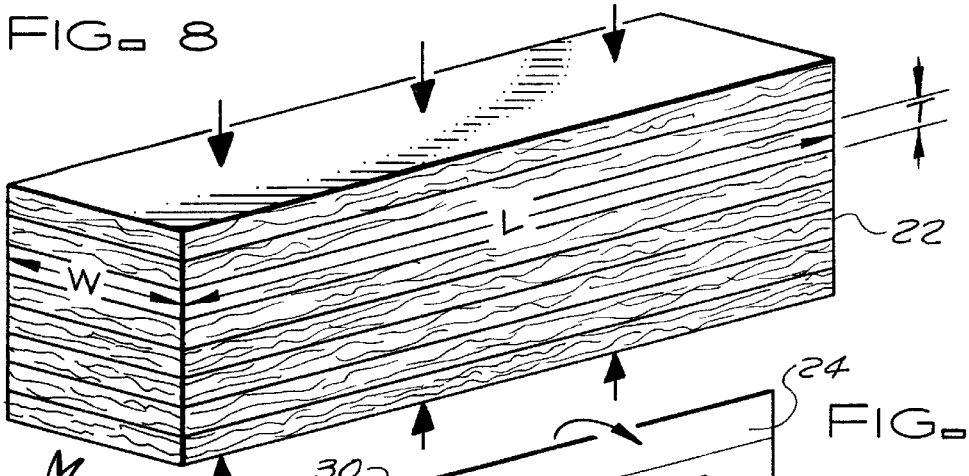
FIG. 9
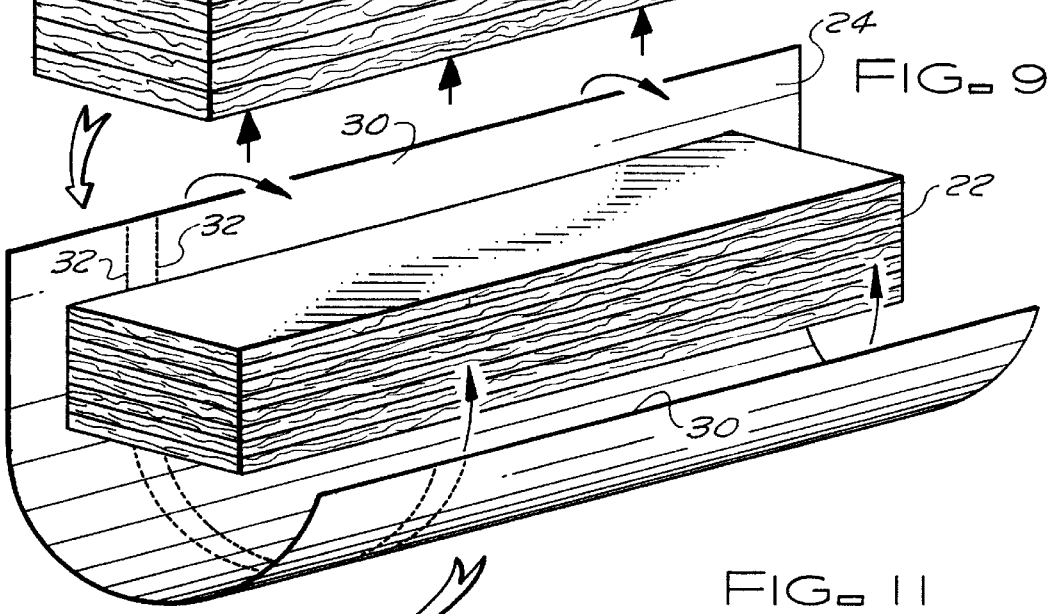
FIG. 10
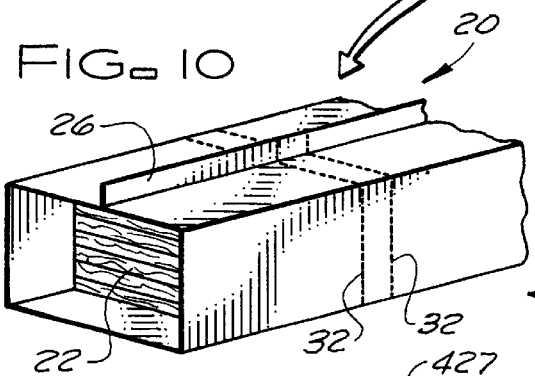
FIG. 11
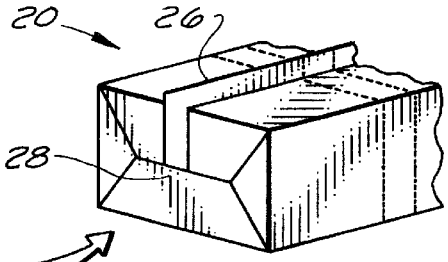
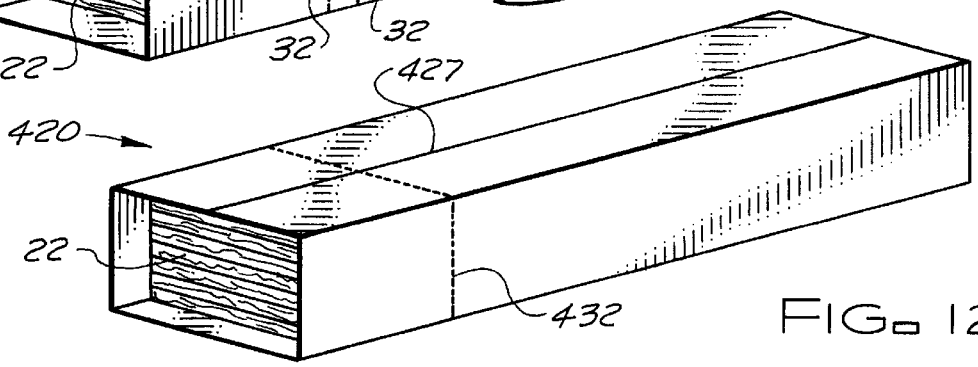
FIG. 12

TOOL FREE, EASY-OPENING INSULATION PACKAGE

BACKGROUND OF THE INVENTION

The present invention relates to a tool free, easy-opening package for resilient insulation batts, such as glass fiber batts, and, in particular, to a tool free, easy-opening package for resilient insulation batts which can be opened by hand, without the use of tools, to gain access to the insulation batts.

Currently, resilient insulation batts, such as glass fiber insulation batts, are sold in packages which require the use of a knife or other similar tool to open the package and gain access to the batts. Typically, a plurality of batts, e.g. eight batts, are stacked one upon the other and compressed to a thickness of about ⅛ their normal thickness or less. These batts are then: a) placed, in their compressed state, within a preformed tubular package which when the formation of the package is complete may be open at one end, open at both ends, or closed at both ends or b) wrapped, in their compressed state, within a sheet of packaging material which is formed into a tubular package with a longitudinal seam and open at one end, open at both ends, or closed at both ends. U.S. Pat. No. 4,805,383, issued Feb. 21, 1989, discloses a batt packaging machine and method of packaging batts wherein the batts are wrapped, in their compressed state, within a sheet of packaging material and the disclosure of U.S. Pat. No. 4,805,383 is hereby incorporated herein in its entirety by reference. When used, the closures provided at one or both ends of these packages are conventional gusset or pillow end closures.

The packaging materials used to form the preformed tubular packages or bags and to wrap the batts are typically polymeric film or paper materials. These materials are not easily torn by hand. For example, the polymeric films used to form these packages tend to elongate or stretch rather than tear when attempts are made to tear these materials by hand and when the materials do tear; the tears in these materials are normally erratic and not easy to make. Accordingly, these packages are normally opened by cutting open the packages with a knife or similar cutting tool.

The use of the conventional gusset or pillow end closures on these packages make such packages difficult to open at their ends due to the multiple layers of polymeric or paper packaging material forming the gusset or pillow end closures which must be cut to open the packages at their ends. Thus, these packages are typically opened, using a knife or similar cutting tool, by cutting through the packaging material and forming cuts in the material that extend for the greater portion of the length of the packages. With these cuts in the packages, the packages open up and are destroyed due to the expansion of the compressed resilient batts within the packages which expand to their normal thicknesses.

The need to open these packages by cutting the packaging material forming the packages causes several problems. Many of the insulation batts packaged within these packages are either provided with facings or are encapsulated within polymeric film envelopes or other similar materials. When the packages are cut open with a knife or similar cutting tool, these facings or encapsulating film envelopes are often cut in the process. In addition, by totally destroying the package in order to open the package, any unused batts from the package are loose.

Thus, there has been a need for a tool free, easy-opening package for resilient insulation batts that can be readily and easily opened by hand without the need to use a cutting tool and a package that can be opened in such a way that any unused batts in the package can be retained in the package until needed.

SUMMARY OF THE INVENTION

The insulation package of the present invention for containing a stack of resilient insulation batts, such as glass fiber batts, is formed from a sheet material, such as but not limited to, a polymeric film or paper material. While the sheet material can be in a preformed seamless tubular form, preferably, the sheet material is wrapped about and completely encircles the batts and has a seam securing edges of the sheet material together that extends longitudinally with respect to the batts, preferably, for at least the length of the batts. The formation of the longitudinal seam in the package creates a stress riser extending the length of the seam along which the package can be easily torn by hand. Where a preformed seamless tubular package is used, a longitudinally extending stress riser can be formed in the package that preferably extends for at least the length of the batts. The term stress riser, as used herein, refers to a narrow elongated area or line within the sheet that has been stressed, e.g. by creasing, scoring, perforating and/or heating or otherwise upsetting the fibers or cell structure of the sheet along the line, to make the sheet less resistant to tearing or separating along the line than prior to making the stress riser and to thereby facilitate the tearing or separation of the sheet along the line and make the sheet easily tearable or separable by hand along the line.

In the package of the present invention, the sheet material preferably has at least one tear line, preferably a perforated line, extending generally perpendicular to and crossing the stress riser for creating an opening in the package through the rupture of the sheet material by hand along the tear line and for permitting the package to be separated by hand along the stress riser from the opening created along the tear line to gain access to the batts within the package. While the package can be open at one or both ends, preferably, the ends of the package are closed and the tear line completely encircles the package to permit the package to be separated into two sections by rupturing the tear line along its entire length.

The insulation package of the present invention is formed about a stack of compressed, resilient insulation batts by creating a stack of resilient fibrous insulation batts that are stacked one upon another with the major surfaces of the batts in contact. The stack of batts is compressed in a direction generally parallel to the thicknesses of the batts and held in compression. In the preferred embodiment of the invention, the package is formed from a sheet of packaging material having a width at least equal to and preferably greater than the length of the batts; a length greater than the transverse peripheral dimension of the stack of compressed batts; and a tear line, preferably a perforated line, spaced from the lateral edges of the sheet and extending parallel to a longitudinal centerline of the sheet. The sheet is wrapped completely about the stack of compressed batts and edges of the sheet extending generally perpendicular to the longitudinal centerline of the sheet are bonded or otherwise joined together while the batts are still compressed to form a seam with a stress riser extending the length of the batts and a tubular package about the compressed batts. The tear line in the sheet extends generally perpendicular to and crosses the seam and stress riser for creating an opening in the package through the rupture of the sheet by hand along the tear line and for permitting the stress riser to be separated by hand from the opening created along the tear line to gain access to the batts within the package. Alternatively, the package can be preformed with a longitudinal seam and stress riser and the compressed batts can be inserted into the preformed tubular package. Preferably, the ends of the package are then closed to completely enclose the stack of batts within the package.

In other embodiments of the invention, the compressed batts are inserted into a preformed seamless tubular package which may be open at both ends or closed at one end (a bag). After the compressed batts are inserted into the preformed seamless tubular package: if the tubular package is open at both ends, the package can be closed at one or both ends; and if the preformed seamless tubular package is closed at one end (a bag), the package can be closed at the second end. Preferably, the preformed tubular package is provided with a longitudinally extending stress riser and a tear line, e.g. a perforated line, in the sheet, extending generally perpendicular to and crossing the stress riser for creating an opening in the package through the rupture of the sheet by hand along the tear line and for permitting the stress riser to be separated by hand from the opening created along the tear line to gain access to the batts within the package.

Preferably, the sheet of packaging material used to form the wrapped package of the present invention has greater tear resistance when stressed in the direction of the longitudinal centerline of the sheet than in a direction perpendicular to the longitudinal centerline of the sheet. By wrapping the sheet about the stack of compressed resilient insulation batts in a direction parallel to the longitudinal centerline of the sheet, the greater tear resistance of the sheet in this direction provides the finished package with better tear resistance to withstand the pressure and hoop stresses exerted on the package by the compressed, resilient; insulation batts within the package.

BRIEF DESCRIPTION OF THE DRAWINGS

FIG. 1 is a schematic perspective view of a first embodiment of the tool free, easy-opening insulation package of the present invention with a portion broken away to show the resilient insulation batts within the package and showing, in phantom line, a tear strip being peeled back from the package.

FIG. 2 is an exploded, schematic perspective view of the easy-opening insulation package of FIG. 1, showing the tear strip and one end portion of the package removed from the easy-opening package to expose the resilient insulation batts within the package.

FIG. 3 is an enlarged view of the circled portion of FIG. 2 showing the package being separated at the stress riser adjacent the butt seam to open the easy-opening package along its length for easy removal of the resilient insulation batts.

FIGS. 8–11 are schematic perspective views illustrating the preferred method of the present invention for forming the easy-opening insulation package of the present invention shown in FIG. 1.

FIG. 12 is a schematic perspective view of a seamless easy-opening insulation package of the present invention, open at one end, with a stress riser represented by a longitudinal line in the upper surface of the package.

DESCRIPTION OF THE PREFERRED EMBODIMENTS

Figure 4:
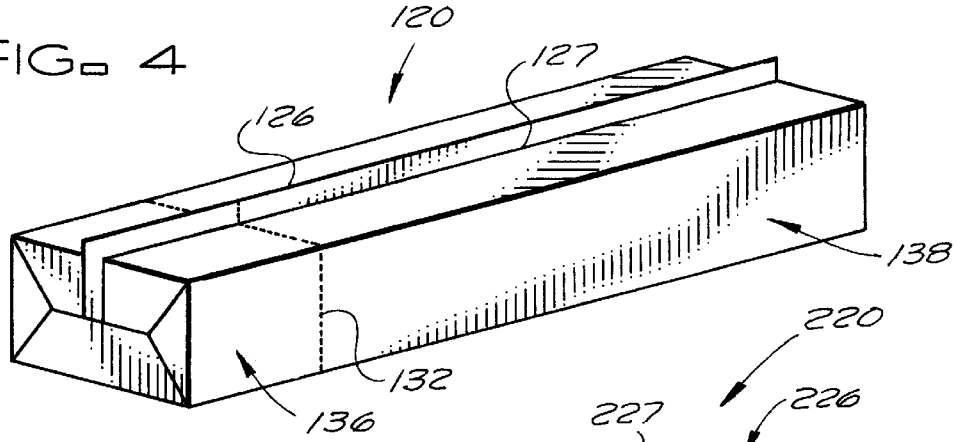
FIG. 4 is a schematic perspective view of a second embodiment of the easy-opening insulation package of the present invention having a single perforated tear line adjacent one end of the package.

As shown in FIGS. 1–7, the easy-open insulation package of the present invention 20 typically includes a plurality of compressed, resilient insulation batts 22 wrapped in a sheet 24 of packaging material, such as but not limited to, polyethylene or other commercially available polymeric film sheets; paper packaging sheets; composite packaging sheets or other commercially available packaging sheets. The resilient insulation batts 22 are typically fibrous insulation batts, such as glass fiber or mineral wool batts, but the batts may be made of other resilient insulation materials. These batts 22 may be unfaced, faced or encapsulated and typically, are about four feet in length, about fifteen or twenty three inches wide, and from about one to eight inches in thickness when uncompressed. In the tool free, easy-opening insulation package 20, the batts 22 are compressed, in a direction parallel to their thicknesses, to thicknesses of about ⅛ or less of their normal uncompressed thicknesses. The compressed resilient insulation batts 22 exert hoop stresses of about 2 to 4 pounds per liner inch on the easy-opening insulation packages 20.

Preferably, polymeric film sheets between about 2 mils and about 5 mils in thickness are used as the sheet material for the easy-opening insulation package 20. Such films may have a greater tear resistance in the machine direction than in the cross machine direction. Accordingly, in the preferred embodiment of the easy-opening insulation package 20 of the present invention, the sheet material 24 is wrapped about the stack of compressed resilient insulation batts in the direction of greater tear resistance. This permits the film sheets 24 of the easy-open insulation packages 20 to better withstand the hoop stresses exerted on the packages by the compressed resilient insulation batts 22 within the packages.

As shown in FIGS. 1–3, the easy-opening insulation package 20 is preferably closed at both ends to fully enclose the insulation batts 22 within the package and includes a longitudinally extending seam 26 with a stress riser 27 adjacent and extending along the base of the seam 26. The end closures 28 are conventional gusset or pillow end closures that are currently used on insulation packages in the industry. The seam 26 and stress riser 27 extend the entire length of the package between the end closures 28. while other seams can be used, preferably, the seam 26 is a butt seam formed by securing two edge portions or edge tabs 30 of the sheet material 24 together. The edge portions or edge tabs 30 can be secured together along their length to form the seam 26 by bonding the tabs through heat welding, ultrasonic welding, adhesive bonding or similar securing means while forming a stress riser 27 adjacent and extending along the base of the seam. While the easy-open package is preferably closed at both ends, the easy open package may be open at one or both ends.

The sheet 24 has a pair of parallel tear lines, preferably perforated tear lines 32, which are typically spaced from each other about two to about two and one half inches. These parallel tear lines 32, preferably, extend completely around the transverse periphery of the package 20 running generally perpendicular to and crossing the seam 26 and stress riser 27 to define a tear strip 34 that extends around the entire package. The tear strip 34 can be easily removed from the package 20, by pushing in on the perforated lines with the hand to start the separation of the tear strip 34 from the package 20; tearing the tear strip 34 between the two perforated lines (about two to about two and one half inches); and then pulling the tear strip 34, as shown in phantom line in FIG. 1, to remove the tear strip from the package and create an opening in the package that preferably encircles the package.

As shown in FIGS. 1 and 2, the tear strip 34 is located adjacent one end of the easy-opening insulation package 20 so that when the tear strip 34 is removed from the package, as schematically shown in FIG. 2, the package is separated into two sections 36 and 38. Section 36 can then be removed from the easy-opening insulation package 20 by hand to thereby expose one end of the insulation batts within the package. While the section 36 is shown being removed intact, to facilitate the removal of the section 36 from the package 20, the section 36 can be opened up along the seam 26 by tearing, pulling apart or separating the sheet 24 by hand along the longitudinally extending stress riser 27 located adjacent the base of the tabs 30.

FIG. 3, which is an enlarged view of the circled portion of FIG. 2, shows the sheet 24 on section 38 of the package being pulled apart, torn or separated at the stress riser 27 adjacent the base of the seam 26 to more fully expose the insulation batts 22 within section 38. The sheet 24 of section 38 is easily pulled apart, torn or separated along the stress riser 27 adjacent the base of the seam 26 by grasping the tabs 30 with one hand and the sheet material adjacent the base of the seam 26 with the other hand and pulling apart the sheet at the stress riser 27 to zipper open the package along the stress riser 27. The easy-opening package may be zippered open for a portion of the seam and stress riser to partially open the package or along the entire length of the seam 26 and stress riser 27, if desired, to fully open package 20.

FIG. 4 shows another embodiment of the easy-opening insulation package 120. The easy-opening insulation package 120 of FIG. 4 is identical to the easy-opening insulation package 20 of FIG. 1, with one exception. Instead of having two tear lines, package 120 has only one tear line 132 located adjacent one end of the package and, preferably, extending entirely around the transverse periphery of the package. The package 120 can be separated into two sections 136 and 138 by tearing the package along the tear line 132 by hand and separated along the longitudinal stress riser 127 adjacent the base of the seam 126 in the same manner as the sheet 24 is separated along the stress riser 27 in the embodiment of FIGS. 1–3 to gain access to the insulation batts 22 within the package.

Figure 5:
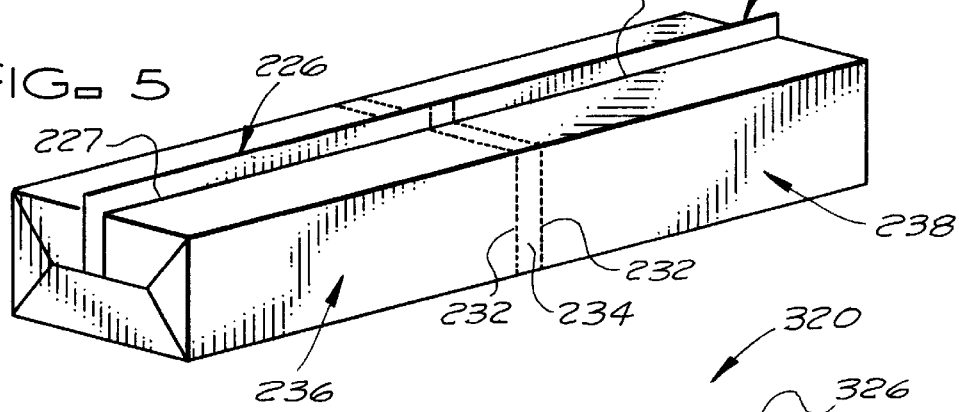
FIG. 5 is a schematic perspective view of a third embodiment of the easy-opening insulation package of the present invention having a single tear strip defined by two perforated tear lines located in a central portion of the package.

FIG. 5 shows another embodiment of the easy-opening insulation package 220. The easy-opening insulation package 220 of FIG. 5 is identical to the easy-opening insulation package 20 of FIG. 1, with one exception. Instead of having two tear lines 32 adjacent one end of the package as in the embodiment of FIG. 1, the easy-opening insulation package 220 has two tear lines 232, preferably extending entirely around the transverse periphery of the package, forming a tear strip 234 located in a central portion of the package. The package 220 can be separated into two equal or substantially equal sections 236 and 238 by tearing open the package by hand with the tear strip 234 formed by the tear lines 232. One or both of the sections 236 and 238 can then be separated along the longitudinal stress riser 227 adjacent the base of the seam 226 in the same manner as the sheet 24 is separated along the stress riser 27 in the embodiment of FIGS. 1–3 to gain access to the insulation batts 22 within the package. If only one section is separated along the stress riser 227 adjacent the base of the seam 226 to open up the section and gain access to the insulation batts 22, the other section can be left intact to hold the remaining insulation batts which will expand to fill the package section after some of the batts are removed from the section for installation. While the easy-opening insulation package 220 of FIG. 5 is shown with two perforated tear lines forming the tear strip 234, if desired, the insulation package can be provided with only a single perforated tear line such as the one used in package 120, but located in the central portion of the package.

Figure 6:
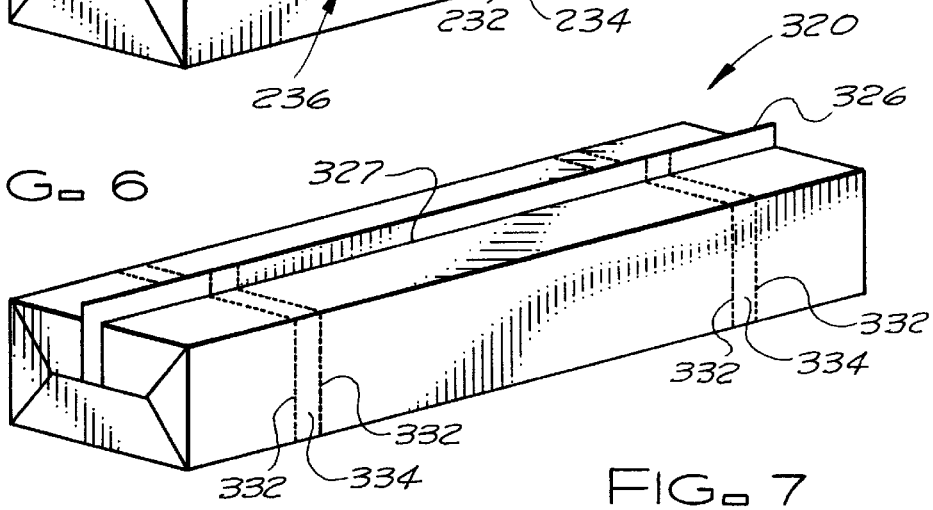
FIG. 6 is a schematic perspective view of a fourth embodiment of the easy-opening insulation package of the present invention having tear strips, each defined by two perforated tear lines, located adjacent opposite ends of the package.
Figure 7:
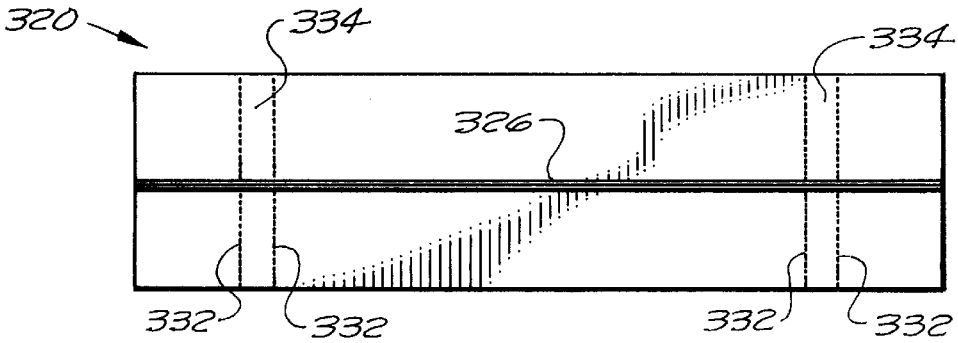
FIG. 7 is a top view of the easy-opening insulation package of FIG. 6.

FIGS. 6 and 7 show another embodiment of the easy-opening insulation package 320. The easy-opening insulation package 320 of FIGS. 5 and 6 is identical to the easy-opening insulation package 20 of FIG. 1, with one exception. Instead of having two tear lines 32 adjacent one end of the package as in the embodiment of FIG. 1, the easy-opening insulation package 320 has two tear lines 332, preferably extending entirely around the transverse periphery of the package, located adjacent each end of the package and forming two tear strips 334 located at the end portions of the package. The package 320 can be separated into two sections by tearing open the package by hand with one of the tear strips 334 formed by the tear lines 332. One or both of the sections can then be separated along the longitudinal stress riser 327 adjacent the base of seam 326 in the same manner as the stress riser 27 is separated in the embodiment of FIGS. 1–3 to gain access to the insulation batts 22 within the package. If desired, an alternative method of gaining access to the batts 22 within the package 320 can be used. As best shown in FIG. 7, the seam 326 and stress riser 327 extend between the tear strips 334 located adjacent each end of the package. By removing the tear strips 334 only along the top surface shown in FIG. 7 and separating the stress riser 327 only between the tear strips 334 the central top portion of the package is opened up and the end portions of the package remain intact. Batts 22 can then be removed from the package through this opening while the remaining batts are retained within the package until needed. While the easy-opening insulation package 320 of FIGS. 6 and 7 is shown with two perforated tear lines adjacent each end of the package forming the tear strips 334, if desired, the insulation package can be provided with only a single perforated tear line adjacent each end, such as the one used in package 120, but located at the end portions of the package. In addition, if the package 320 is intended to be opened only along the upper surface by the alternative method discussed above leaving the end portions of the package intact, the perforated tear lines can be limited to the upper surface of the package shown in FIG. 7.

FIGS. 8–11 schematically illustrate the preferred method of forming the easy-opening insulation packages of the present invention. The method includes forming a stack of resilient insulation batts 22, e.g. glass fiber insulation batts, as shown in FIG. 8. The batts 22 each have major surfaces defined by a length "L" and a width "W" and each have a thickness "T". The batts 22 are stacked one upon another with the major surfaces of the batts in contact. The batts 22 are then compressed in a direction generally parallel to the thicknesses of the batts and held in compression as shown in FIG. 9.

A sheet of packaging material 24 is then wrapped about the stack of compressed batts as shown in FIG. 9. The sheet 24 has a width at least equal to the length of the batts and preferably greater than the length "L" of the batts 22 so that an end closure 28 can be formed on at least one end and preferably on both ends of the easy-open insulation package. The sheet 24 has a length greater than the transverse peripheral dimension of the stack of compressed batts so that a seam, such as a butt seam 26 and adjacent stress riser 27, can be formed from tabs or edge portions 30 that extend generally perpendicular to the longitudinal centerline of the sheet 24. The sheet 24 also has one or more perforated lines tear 32 spaced from the lateral edges of the sheet and extending parallel to the longitudinal centerline of the sheet such as the perforated tear lines shown in the easy-open insulation packages of FIGS. 1–7.

After the sheet 24 is wrapped completely about the stack of compressed batts, the tabs 30 are secured together to form a tubular package about the compressed batts, with a seam extending the length of the batts and preferably beyond the ends of the batts as shown in FIG. 10. Preferably, the seam 26 and stress riser 27 are formed by heat welding tabs 30 of the sheet together. The perforated tear line or lines 32 extend generally perpendicular to and cross the seam 26 and stress riser 27 for creating an opening in the package through the rupture of the sheet by hand along the perforated tear line or lines and for permitting the stress riser 27 to be separated by hand from the opening created along the perforated line to gain access to the batts within the package.

In the preferred embodiments shown in FIGS. 1–7, the ends of the easy-open insulation package 20 are then closed and sealed about both ends of the stack of insulation batts by forming gusset or pillow end closures from the lateral edges of the sheet. The method of forming these end closures is a conventional technique commonly used in the industry and as stated above, one or both ends of the easy-opening insulation package may be left open.

Preferably, the sheet 24 used to form the package has a greater tear resistance in a direction parallel to the longitudinal centerline of the sheet than is a direction perpendicular to the longitudinal centerline of the sheet. By wrapping the sheet 24 about the stack of compressed insulation batts in the manner described above, the sheet provides the package with greater toughness for resisting the hoop stresses exerted on the package by the compressed resilient insulation batts 22.

FIG. 12 shows an embodiment 420 of the easy-opening insulation package which has no longitudinal seam. As shown the package is closed at one end and open at the other end. However, as with the other embodiments of the invention, the package 420 may also be closed at both ends or open at both ends. The package 420 is made from a tubular sheet that is provided with a longitudinally extending stress riser 427. The stress riser 427 is formed in the tubular sheet by longitudinally scoring, creasing or otherwise forming the longitudinally extending stress riser in the tubular sheet, preferably before inserting the insulation batts into the package. As shown, the package 420 is also provided with a circumferential tear line, preferably a perforated line 432, adjacent one end of the package. However, the package 420 can also be provided with double tear lines such as the tear lines 32 of package 20; single or double tear lines centrally located on the package such as tear lines 232 of package 220; and single or double tear lines adjacent each end of the package such as the tear lines 332 of package 320.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. An insulation package containing resilient insulation batts, comprising:

a plurality of resilient insulation batts; the batts each having major surfaces defined by a length and a width and each having a thickness; the batts each having a longitudinal centerline; the batts being stacked one upon another with the major surfaces of the batts in contact and being compressed in a direction generally parallel to the thicknesses of the batts and held in compression within a package;

the package comprising a tubular sheet material that completely encircles the batts and has a stress riser extending longitudinally with respect to the batts for the length of the batts; and the sheet material having a first perforated tear line therein extending generally perpendicular to and crossing the stress riser for creating an opening in the package through the rupture of the sheet material by hand along the first tear line and for permitting the package to be separated by hand along the stress riser from the opening created along the first tear line to gain access to the batts within the package.

2. The insulation package according to claim 1, wherein:

the first tear line completely encircles the package to permit the package to be separated into two sections by rupturing the first tear line along its entire length.

3. The insulation package according to claim 2, wherein:

the first tear line is located adjacent a first end of the package.

4. The insulation package according to claim 2, wherein:

the first tear line is located in a central portion of the package.

5. The insulation package according to claim 1, including:

a second perforated tear line extending generally perpendicular to and crossing the stress riser for creating an opening in the package through the rupture of the sheet material by hand along the second tear line and for permitting the stress riser to be separated by hand from the opening created along the second tear line to gain access to the batts within the package; the second tear line being spaced from the first tear line.

6. The insulation package according to claim 5, wherein:

the first tear line is located adjacent a first end of the package and the second tear line is located adjacent a second end of the package.

7. The insulation package according to claim 5, wherein:

the second tear line is located adjacent the first tear line and together with the first tear line forms a tear strip.

8. The insulation package according to claim 1, wherein:

the first tear line completely encircles the package to permit the package to be separated into two sections by rupturing the first tear line along its entire length and the second tear line completely encircles the package to permit the package to be separated into two section by rupturing the second tear line along its entire length.

9. The insulation package according to claim 8, wherein:

the first tear line is located adjacent a first end of the package and the second tear line is located adjacent a second end of the package.

10. The insulation package according to claim 8, wherein:

the second tear line is located adjacent the first tear line and together with the first tear line forms a tear strip.

11. The insulation package according to claim 10, wherein:

the tear strip is located adjacent a first end of the package.

12. The insulation package according to claim 10, wherein:

the tear strip is located in a central portion of the package.

13. The insulation package according to claim 10, wherein:

the tear strip is located adjacent a first end of the package and there is a second tear strip located adjacent a second end of the package.

14. The insulation package according to claim 1, wherein:

the package has first and second ends and is closed at the first and second ends.

15. The insulation package according to claim 1, wherein:

the sheet material comprises a polymeric sheet material.

16. The insulation package according to claim 1, wherein:

the sheet material comprises a paper sheet material.

17. The insulation package according to claim 1, wherein:

the sheet material has a greater tear resistance in the direction encircling the batts.

18. The insulation package according to claim 1, wherein:

the stress riser is adjacent a longitudinally extending seam of the package which secures edges of the sheet material together and extends longitudinally with respect to the batts for the length of the batts.

19. The insulation package according to claim 18, wherein:

the longitudinally extending seam is a butt seam comprising two edges of the sheet bonded together as a tab.

20. An insulation package containing resilient insulation batts, comprising:

a plurality of resilient insulation batts; the batts each having major surfaces defined by a length and a width and each having a thickness; the batts being stacked one upon another with the major surfaces of the batts in contact and being compressed in a direction generally parallel to the thicknesses of the batts and held in compression within a package;

the package comprising a sheet material that completely encircles the batts and is closed at both ends; the sheet material having a seam securing edges of the sheet material together and extending longitudinally with respect to the batts for the length of the batts; the sheet having a stress riser adjacent and extending the length of the seam; and the sheet material having a perforated tear line extending generally perpendicular to and crossing the seam for creating an opening in the package through the rupture of the sheet material by hand along the perforated tear line and for permitting the package to be separated by hand along the stress riser from the opening created along the perforated tear line to gain access to the batts within the package; the perforated tear line completely encircling the package to permit the package to be separated into two sections by rupturing the perforated tear line along its entire length.

* * * * *